US010269241B2

(12) United States Patent
Fuereder et al.

(10) Patent No.: US 10,269,241 B2
(45) Date of Patent: Apr. 23, 2019

(54) METHOD FOR GEOGRAPHIC REGION DETECTION OF TRAFFIC INFRASTRUCTURE

(71) Applicant: Siemens Aktiengesellschaft, Munich (DE)

(72) Inventors: Herbert Fuereder, Vienna (AT); Thomas Sachse, Bruckmuehl (DE)

(73) Assignee: Siemens Mobility GmbH, Munich (DE)

( * ) Notice: Subject to any disclaimer, the term of this patent is extended or adjusted under 35 U.S.C. 154(b) by 69 days.

(21) Appl. No.: 15/228,015

(22) Filed: Aug. 4, 2016

(65) Prior Publication Data

US 2017/0039847 A1 Feb. 9, 2017

(30) Foreign Application Priority Data

Aug. 5, 2015 (DE) ..... 10 2015 214 955

(51) Int. Cl.

*G08G 1/01* (2006.01)
*G08G 1/127* (2006.01)
*G08G 1/056* (2006.01)

(52) U.S. Cl.

CPC ..... *G08G 1/0116* (2013.01); *G08G 1/0112* (2013.01); *G08G 1/0129* (2013.01); (Continued)

(58) Field of Classification Search

CPC .. G08G 1/0116; G08G 1/0112; G08G 1/0141; G08G 1/056; G08G 1/127; G08G 1/116; G08G 1/112

See application file for complete search history.

(56) References Cited

U.S. PATENT DOCUMENTS

2012/0101704 A1* 4/2012 Wagner ..... G01S 7/003 701/96
2013/0060146 A1* 3/2013 Yang ..... A61B 5/055 600/476

(Continued)

FOREIGN PATENT DOCUMENTS

DE 102013205057 8/2014
DE 102013227144 12/2014

(Continued)

OTHER PUBLICATIONS

Schroedl et al Knowledge Discovery, "Mining GPS Traces for Map Refinement", Data Mining and Knowledge Discovery, vol. 9, 2004, pp. 59-87.

*Primary Examiner* — Yonel Beaulieu
*Assistant Examiner* — Martin A Weeks
(74) *Attorney, Agent, or Firm* — Cozen O'Connor

(57) ABSTRACT

A method for geographic region detection of traffic infrastructure via a receiver disposed in the region of the traffic infrastructure for a detection region of the receive unit, wherein status data of vehicles is communicated by the vehicles several times to the receive unit via wireless communication during the period in which vehicles pass through the detection region of the receiver, the receiver, or a processor connected to the receive unit, computes a vector for each vehicle, where the vector extends from a first position of the vehicle to a second position of the vehicle, and the receiver or the processor determines directions of travel of the vehicles and the geographic location of roadways and/or lanes of the roadways of the traffic infrastructure in the detection region from the vectors of all the vehicles.

15 Claims, 2 Drawing Sheets

(52) U.S. Cl.
CPC ..... *G08G 1/0141* (2013.01); *G08G 1/056* (2013.01); *G08G 1/127* (2013.01)

(56) References Cited

U.S. PATENT DOCUMENTS

| | | | | |
|---|---|---|---|---|
| 2014/0302774 | A1* | 10/2014 | Burke ..... | H04H 20/57<br>455/3.05 |
| 2014/0358414 | A1 | 12/2014 | Ibrahim et al. | |
| 2016/0055745 | A1 | 2/2016 | Karacan et al. | |

FOREIGN PATENT DOCUMENTS

| | | |
|---|---|---|
| DE | 102013107960 | 1/2015 |
| WO | WO 2014080023 | 5/2014 |

* cited by examiner

METHOD FOR GEOGRAPHIC REGION DETECTION OF TRAFFIC INFRASTRUCTURE

BACKGROUND OF THE INVENTION

1. Field of the Invention

The invention relates to a method for geographic region detection of traffic infrastructure suitable for use in Road Side Units (e.g., receivers), wherein these Road Side Units can form an element of a cooperative system.

2. Description of the Related Art

Cooperative systems in connection with traffic infrastructure are the object of intensive current research and development. They are intended to make it possible for highway operators, traffic infrastructure, vehicles and their drivers as well as other road users to cooperate with one another in order to make possible a journey that is as efficient, safe and comfortable as possible.

To this end systems, are provided that make possible communication in the form of exchange of data between vehicles and infrastructure. Such communication systems are known for example by the acronyms V2R (Vehicle-to-Roadside) or V2V (Vehicle-to-Vehicle). These communication systems are abbreviated in Europe to ITS-G5 and in the USA to DSRC/WAVE.

The present invention relates to the field of V2R communication, in which Common Awareness Messages (CAM) are usually communicated from the vehicles that are part of road traffic to receive units of the infrastructure. The content of these CAM can be a very wide diversity of traffic-relevant data, such as information about the current position and speed of the communicating vehicle along with the associated point in time of the measurement.

This data is usually collected, evaluated and sent on to superordinate traffic control centers by the receive units. Finally, in these centers, macroscopic data averaged over certain route and time segments, such as traffic densities and journey speeds in specific route segments, for example, is analyzed. Congestion or also accident warnings can likewise be generated and output in this way, for example.

The communication between vehicles on a specific route segment and the receiver that is monitoring the segment is usually ongoing, i.e., with a high frequency of the CAM communications. In this case, the V2R communication begins when the vehicle enters the detection area of a receiver and ends when it leaves this detection area. The distance that a vehicle usually covers within such a detection area amounts to around 1 km and, within this detection area, there are many paths (different roadways or lanes of roadways) along which vehicles can travel. As a result, it is sensible in some cases to divide up the entire detection area into a number of segments, within which the collected data is averaged and edited for transfer to the superordinate traffic control centers.

To do this, it was previously necessary to detect the geographic topology of each traffic region manually before the commissioning of the receive unit, configure it in the receiver and define the corresponding segments into which the overall detection region was to be divided. Such configuration and detection is very time-consuming, therefore cost-intensive and must be done very accurately. Also, this process must be undertaken again when external circumstances change (e.g., after roadworks) or each time that the receiver is used in another route segment.

SUMMARY OF THE INVENTION

It is therefore an object of the present invention to provide a method in the form of a learning algorithm for a receiver of a cooperative system that renders manual detection and configuration of the receiver obsolete and is simple enough to be able to be implemented directly at the receiver.

This and other objects and advantages are achieved in accordance with the invention by a method for geographic region detection of traffic infrastructure via a receiver disposed in the region of the traffic infrastructure for a detection region of the receiver, in that status data of a number of vehicles, where each status data includes at least a position of the respective vehicle and if necessary a time at which the position was determined, is communicated to the receiver via wireless communication by the vehicles several times in the period during which the vehicles are passing through the detection region of the receiver.

The objects and advantages of the invention are further achieved by the method in accordance with the invention in that, the receiver or a processor connected to the receiver, computes a vector for each vehicle, where the vector extends from a first position, i.e., the position of the vehicle received as the first position, to a second position, i.e., the position of the vehicle received as the last position, in the detection region. In addition, from the vectors of all vehicles, the receiver or the processor determines directions of travel of the vehicles as well as the geographic location of roadways and/or lanes of the roadways of the traffic infrastructure in the detection region.

A method is thereby provided, by which the topology of the traffic flows present within the detection region of the receiver is determined and through which conclusions can be drawn about the topology of the roads (in particular and the traffic infrastructure in general) monitored by the receiver. Manual detection of the topography and configuration of the receiver is thus no longer necessary. In particular, in conjunction with mobile receivers, which are to be used at constantly changing deployment sites, the described method therefore implies a significant saving in costs and working time.

The processing needed for the detection of the topography can be done either by the respective receiving unit itself or by processor that are connected to the receivers via wireless communication, for instance. Such a processor can, e.g., be a computer located at some distance from the receiver, such as the central computer of the cooperative system.

In addition, there is the advantage of the method being able to be executed a number of times, preferably periodically, through which imprecisions in the positions of the vehicles, which are usually determined by a certain scattering of underlying GPS measurements, can be compensated for.

In the determination of the vector of a vehicle a first position of the vehicle is selected as the point of origin of the vector and a second position of the vehicle in the receive region of the receiver as the end point of the vector. Such a vector is intended to approximately represent the movement of the vehicle in the receive region. As a result, it is actually not absolutely necessary, but is thoroughly sensible, to use its first received position (on entry into the receive region) as the first position and its last received position (before exit from the receive region) for this purpose.

In a preferred embodiment of the method, the directions of travel of the vehicles are determined by the vectors of all vehicles being grouped in accordance with an angle that the respective vector makes with a reference vector. This provides an especially simple and computationally uncomplicated method for determining the directions of travel of the vehicles. The computation of the angle between the respective vector of the vehicle and the reference vector can be established, for example, by computing the scalar product of the two vectors. Subsequently, all vectors are subdivided into clusters, of which the number matches the number of those directions in which the detected traffic flows are moving. In this case, there can be provision that, in the determination of the directions of travel of the vehicles, a specific range of angles is assigned to a specific direction of travel in each case.

A full angle ($2\pi$) can be divided in such cases into two ranges, for example, i.e., into a first range (between $3\pi/2$ and $\pi/2$) as well as into a second range (between $\pi/2$ and $3\pi/2$). Depending on which of the two ranges into which the angle of specific vector falls, the assigned vehicle is now assigned one of two directions. In the case of a four-lane freeway (two lanes per direction of travel) two clusters of vectors would thus be produced (one cluster per direction of travel). For more complicated topologies, further subdivisions of the full angle would be necessary.

In another embodiment, the roadways and/or the lanes of the roadways of the traffic infrastructure are determined by the vectors of all vehicles being grouped in accordance with a normal distance of the receiver from the respective vector. This division of the vectors in accordance with their respective normal distance from the receiver leads to a higher spatial resolution of the individual traffic flows. If the vectors of the vehicles were previously only assigned to one of two clusters (one cluster per direction of travel) on the four-lane freeway given as an example above, then this preferred embodiment of the method leads to an assignment of a vector to one of a total of four clusters (one cluster per lane of the freeway).

In a preferred embodiment, an averaged entry point and also an averaged exit point of those vehicles that are driving on this roadway or in this lane is determined for each roadway and/or lane of the roadways.

With a sufficiently high number of vehicles participating in the method, these averaged entry and exit points correspond as a good approximation to the middle of the respective roadway or of the respective lane of the roadway. Thus, the relationship between the detected traffic flows within the detection region of the receiver and the topology of the traffic infrastructure monitored by the receiver is established.

In a preferred embodiment, the status data is detected by the vehicles. Devices provided separately for status data detection are thus superfluous. In such cases, status data detection by means of GPS technology has the additional advantage, for example, that equipment usually present in vehicles, such as navigation systems or cell phones, can be used for detection of the status data. It should be understood other navigation systems, such as Galileo, can also be used.

The use of widespread and established technologies is also a fundamental idea of the concept of cooperative systems, because such systems only make sense when as many road users as possible are communicating with each other. Thus, the data detected by the vehicles is also preferably communicated to the receiver by widely-used technologies of wireless communication, such as e.g. ITS-G5, DRSC/WAVE, mobile radio or WLAN.

In a further preferred embodiment of the method, the status data is communicated periodically to the receiver, e.g. with a frequency of 0.1 Hz to 100 Hz. Depending on the size of the respective detection region and also on the average speed of the vehicles that are driving through the traffic infrastructure in this region, the frequency of the status data communication is preferably selected so that the positions identified as first or last received position of the vehicles match the actual entry and exit points of the vehicles into and out of the detection region of the receiver as well as possible.

In a preferred embodiment of the method, the position detected as the last position is that position of the vehicle for which, after it has been communicated to the receiver, no further status data of this vehicle has reached the receiver for a defined period of time.

Once again, this involves an especially simple method entailing little computational outlay for determining the position of the vehicle received as its last position. After a specific period of time has elapsed, preferably in conjunction with the frequency of the status data communication, that position of the vehicle, which was contained in the last received status data of the vehicle is identified as its last position. The higher the frequency of the data communication, the greater the probability that the position of the vehicle received as its last position matches that position at which the vehicle leaves the detection region.

In a preferred embodiment of the method, the accuracy of the method to be increased by the use of additional topology information. In particular there is provision for information about the topology of the traffic infrastructure from other sources is used to increase the accuracy of the geographic region detection. For example, information transmitted from cell phone networks via MAP telegram is also included.

In a preferred embodiment of the method in accordance with the invention, the receiver unit of the processor divides the maximum detection region into a number of segments.

In accordance with this preferred embodiment, the detection region is divided into a number of segments especially for regular operation of the receiver after calibration. Thus, in the case of the example of the four-lane freeway, the reception area can be divided up so that each lane is assigned its own segment. In addition, it is likewise possible to divide up the individual lanes normal to the direction of travel into further segments, which is especially sensible when the detection region is especially large and/or when the topology of the traffic infrastructure to be detected is especially complicated. These segments then serve as regions within which, in normal operation of the receiver after calibration, specific data will be averaged.

It is also an object to provide a receiver for use with the method in accordance with the disclosed embodiments, wherein the receiver is configured to receive status data from a number of vehicles, where each status data includes a position of a respective vehicle and also if necessary a time at which the position was determined and which was communicated by wireless communication to the receiver a number of times by the vehicles while the vehicles passed through the detection region, and receiver or a processor connected to the receiver, is configured to calculate a vector for each vehicle, where the vector extends from a first position, i.e., the position of the vehicle received as the first position, to a second position, i.e., the position of the vehicle received as the last position in the detection region. In addition, the receiver processor or processor is configured to determine directions of travel of the vehicles as well as the geographic location of roadways and/or lanes of the roadways of the traffic infrastructure in the detection region from the vectors of all vehicles.

The receiver in accordance with the invention is suitable for functioning as a receiver in one of the disclosed embodiments of the method in accordance with the invention.

It is also an object of the invention to provide a computer program product which comprises a computer program and is which directly loadable into a memory of the above-described receiver, or into the memory of a processor assigned to the receiver, with computer program instructions for executing all steps of the method in accordance with the invention when the computer program is executed by the receiver or by the processor.

The inventive method in accordance with disclosed embodiments involves methods within the framework of which large volumes of data must be processed under some circumstances. Consequently, the method is advantageously implemented as a computer program.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention will now be explained in greater detail on the basis of an exemplary embodiment. The drawings are exemplary and, although intended to illustrate the inventive idea, should in no way be seen as restricting it or indeed representing a definitive version, in which figures.

DETAILED DESCRIPTION OF THE EXEMPLARY EMBODIMENTS

Figure 1:
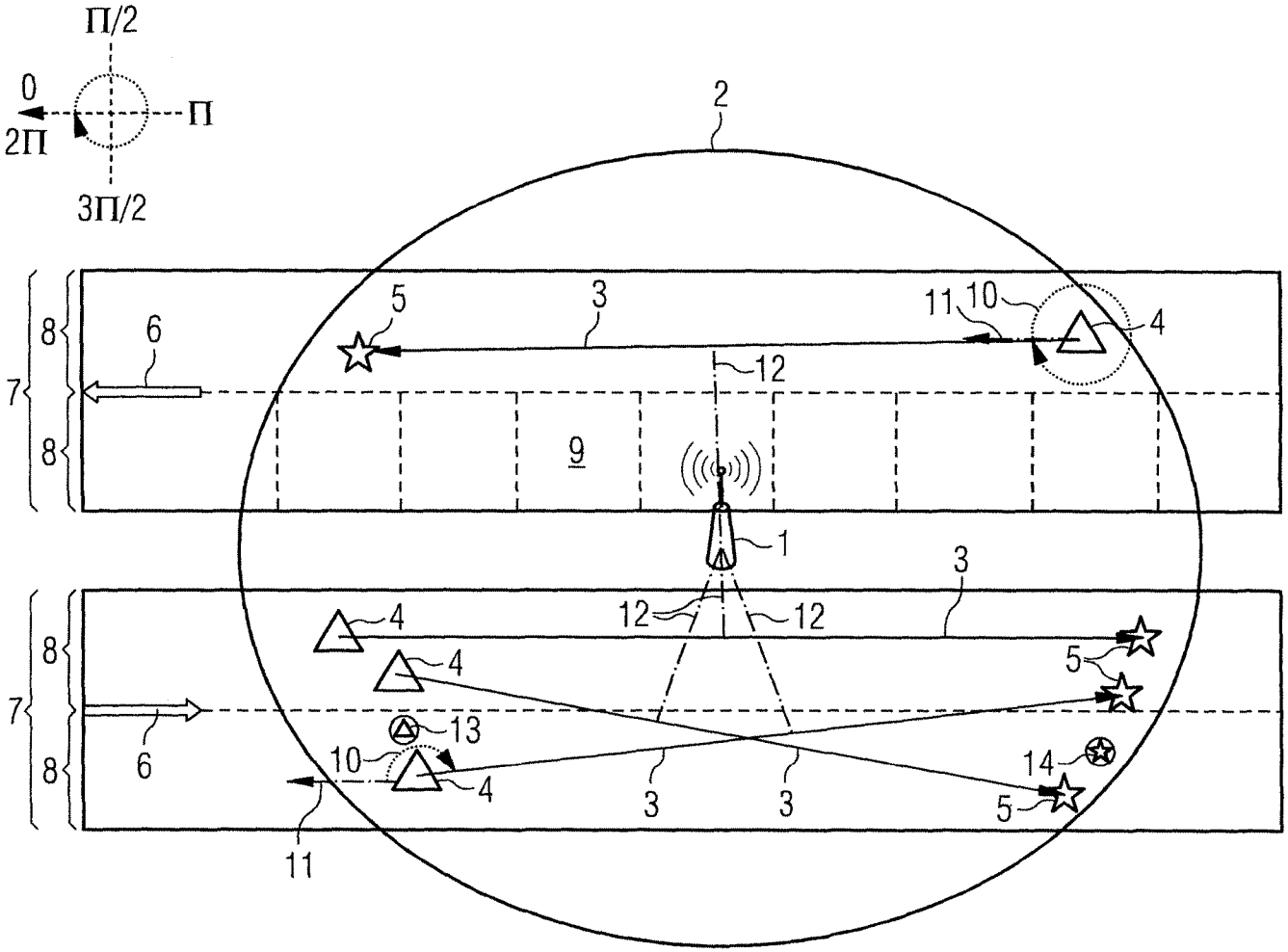
FIG. 1 shows a schematic diagram of a traffic infrastructure in the form of a four-lane freeway, which is monitored by a receiver in accordance with the invention.

FIG. 1 shows a traffic infrastructure, in the form of a segment of a four-lane freeway. The segment shown has two roadways 7, on which roadways 7 vehicles (not shown) are each moving in one direction. In this example, each roadway 7 has two lanes 8.

A receiver 1 is disposed in the area between the two roadways 7. A detection region 2 of the receiver 1 is formed in the actual case approximately circular in shape and covers a significant part of each of the two roadways 7.

Shown within the detection region 2 are four vectors 3, which each extend from a position 4 of a vehicle received as first position to a position 5 received as the last position. Each of the vectors 3 forms a specific angle 10 with a reference vector 11. Each vector 3 has a normal distance 12 from the receiver 1.

In particular terms, the overtaking lane 8 of the upper roadway 7 is divided into seven segments 9. For two vectors 3 of the right-hand lane 8 of the lower roadway 7, an averaged entry point 13 and an averaged exit point 14 are shown.

The receiver in FIG. 1 involves a receiver in accordance with the invention that executes a computer program to determine the geographic location of the roadways/lanes.

Vehicles are moving in one of a total of two possible directions of travel 6 on the upper and lower roadway 7 of the segment of freeway shown in FIG. 1. Two lanes 8 are available for this purpose on each roadway 7.

In accordance with the invention, a number of these vehicles communicate status data to the receiver 1 while they pass through the detection region 2 of the receiver 1. Typically this communication of status data to the receiver 1 occurs at a frequency of around 10 Hz, but depending on the technology or device used in the vehicles for data communication, frequencies that lie well below this typical value are also possible.

The frequency with which the measurement of the status data occurs in the vehicles influences the quality of the region detection in accordance with the method of the invention in a certain way. The higher this frequency, i.e., the frequency of the position measurement, the closer the position 4 received as first position and the position 5 of the vehicle received as last position lie to that position at which the vehicle drives into the detection region 2 of the receiver 1 or leaves the detection region 2 of the receiver 1 again.

This status data contains at least one position of the vehicle as well as possibly the time of the measurement. However, it is likewise conceivable for the receiver 1 to log the time at which the status data of the vehicle is communicated and for the status data not to contain any time of position measurement.

In the actual exemplary embodiment, the status data is detected by GPS and the status data is communicated to the receiver 1 by ITS-G5 communication.

After the status data of N vehicles has been communicated to the receiver 1 within a predetermined detection period, the receiver 1 evaluates the status data of the N vehicles, in that the next steps in the method are executed. The communication and the receipt of status data of subsequent vehicles can continue in parallel thereto, however, or can also be interrupted.

From the status data communicated by the vehicles to the receiver 1, the receiver now establishes for each vehicle the position 4 received as the first position, which is identified as that position of the vehicle that is contained in the status data communication of the respective vehicle, as well as the position received as the last position 5 of the vehicle. The latter is identified as the position of the vehicle that is contained in the last status data communication of the vehicle, before the vehicle has left the detection data region 2 again.

For each vehicle, the vector 3 that extends from the position 4 received as the first position to the position 5 received as the last position of the respective vehicle is now calculated. For N vehicles that have passed through the detection region 2 during the detection period, there are thus now N vectors 3 available.

Next, the receiver 1 computes the angle 10 that each of the vectors 3 makes with the reference vector 11 in each case. This can be done, for example, by computing the scalar product of the respective vector with the reference vector 11. The reference vector 11 in this case is naturally always the same for all angle computations.

Ranges of angles are now determined in accordance with which the N vectors 3 are divided up according to their respective angle 10. In the specific example, one of the total of four vectors 3 shown has an angle 10 in the range between $3\pi/2$ and $\pi/2$ (first range of angles) and the three vectors 3 each have an angle 10 that lies within the range between $\pi/2$ and $3\pi/2$ (second range of angles).

In accordance with this division, the vector 3 of which the angle 10 lies in the first range of angles is assigned the first direction of travel 6, and thus the upper roadway 7, and the other three vectors 3, of which the angle 10 lies in the second range of angles in each case, are assigned the second direction of travel 6—and thus the lower roadway 7.

Thus, there are now two clusters of vectors 3, where $N_1$ vectors 3 are assigned to the first cluster and $N_2$ vectors 3 to the second cluster, and where $N_1+N_2=N$. In this case, the geographic region over which all vectors 3 of a cluster extend defines the geographic location of the roadway 7.

The normal distance 12 between the respective vector 3 and the receiver 1, or any other reference point is now computed in each case for all vectors 3 in one of the two clusters. Subsequently, normal distance ranges are determined, in accordance with which the vectors 3 of this cluster are further divided in accordance with their respective normal distance 12.

If, for example, the set $N_2$ of vectors 3 assigned in the particular exemplary embodiment to the second cluster is considered, then one vector 3 has a shorter normal distance 12 and two vectors 3 have a longer normal distance 12. Accordingly, the second cluster itself is divided into two subclusters with $N_2'$ vectors 3 in the first subcluster or $N_2''$ in the second subcluster, where $N_2'+N_2''=N_2$.

The first cluster (the upper roadway 7) of the specific exemplary embodiment is treated the same, where only one vector 3 is however shown in the specific example.

A lane 8 of the roadway 7 associated with the respective cluster is now assigned to the subclusters of a cluster.

In order to now be able to deduce from the traffic flows within the detection region 2 completely detected during the detection period the geographic location of the corresponding traffic infrastructures, further method steps are required, which can appear as follows: From the quantity of the vectors 3 assigned to a specific subcluster, and thus to a specific lane 8 of a roadway 7, the averaged entry point 13 and also the averaged exit point 14 of all vehicles assigned to this subcluster is determined.

In the specific exemplary embodiment, this is shown for the two assigned to the subcluster $N_2''$ with two apostrophes of the second cluster $N_2$. These averaged entry 13 and exit points 14 are now identified by those points at which the vehicles enter the segment of the lane 8 assigned to the subcluster of the cluster or leave this segment of the lane 8 again. A vector can now be formed in its turn between these two averaged entry 13 and exit points 14, which represents the modeled course of the corresponding lane 8.

The entire detection region 2 of the receiver 1 can thus be divided into segments 9. On the one hand, the lanes 8 or roadways 7 just established of the traffic infrastructure itself are the obvious candidates. On the other hand, it is also possible to divide up individual route segments, such as the overtaking lane 8 of the upper roadway 7 into further length segments 9. These segments can be used during normal operation of the receiver 1 not to assign the status data that is communicated constantly by the vehicles in the detection region 2 to the receiver 1 to a specific position but to just one of these segments 9 and subsequently to average all status data assigned to this segment 9 over the respective segment 9.

Figure 2:
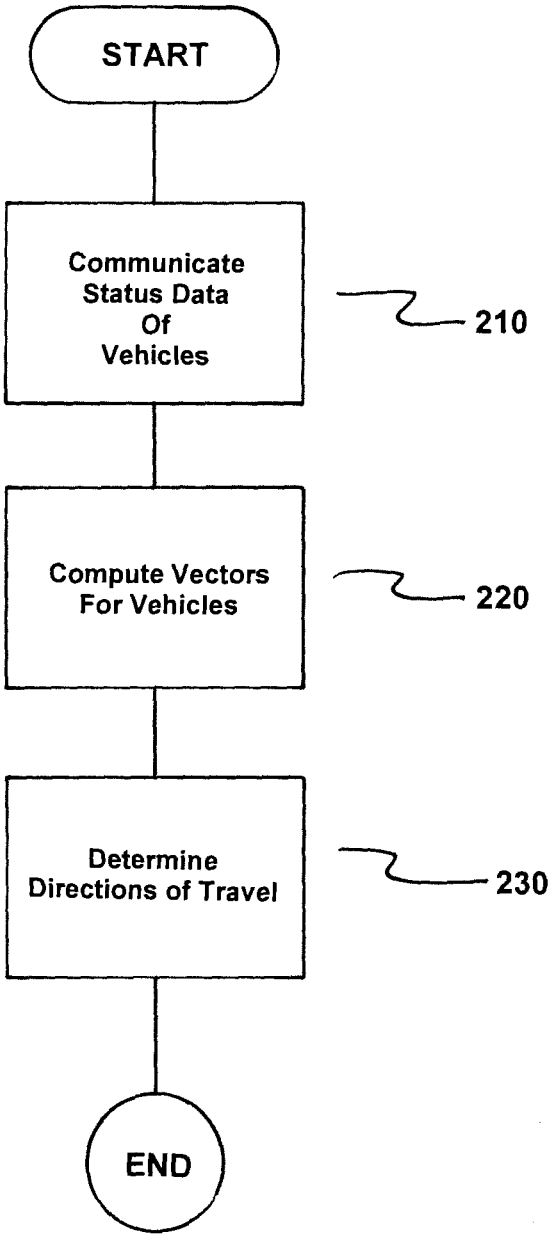
FIG. 2 is a flowchart of the method in accordance with the invention.

FIG. 2 is a flowchart of a method for geographic region detection of traffic infrastructure via a receiver 1 disposed in a region of the traffic infrastructure for a detection region 2 of the receiver 1. The method comprises communicating several times to the receiver 1, by the vehicles, status data of the vehicles during a period in which the vehicles pass through the detection region 2 of the receiver 1 via wireless communication, as indicated in step 210. In accordance with the invention, the status data each including at least a position of a respective vehicle and if necessary a time at which the position was determined.

Next, a vector 3 is computed for each vehicle computing by either (i) the receiver 1 or (ii) a processor connected to the receiver 1, as indicated in step 220. Here, the vector 3 extends from a first position to a second position.

Next, directions of travel 6 of the vehicles and a geographic location of at least one of (i) roadways 7 and (ii) lanes 8 of the roadways 7 of the traffic infrastructure in the detection region 2 are determined by either (i) the receiver 1 or (ii) the processor from vectors 3 of all vehicles, as indicated in step 230.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for geographic region detection of traffic infrastructure via a receiver disposed in the traffic infrastructure for a detection region of the receiver, the method comprising:

communicating several times to the receiver disposed in the traffic infrastructure, by vehicles, status data of the vehicles during a period in which the vehicles pass through the detection region of the receiver disposed in the traffic infrastructure via wireless communication, the status data each including at least a position of a respective vehicle and if necessary a time at which the position was determined;

computing, by one of (i) the receiver disposed in the traffic infrastructure and (ii) a processor connected to the receiver disposed in the traffic infrastructure, a vector for each vehicle, the vector extending from a first position to a second position;

determining, by one of (i) the receiver disposed in the traffic infrastructure and (ii) the processor from vectors of all vehicles, directions of travel of the vehicles and a geographic location of at least one of (i) roadways and (ii) lanes of the roadways of the traffic infrastructure in the detection region;

forwarding the determined directions of travel of the vehicles and a geographic location to a control center in which the determined directions of travel of the vehicles and a geographic location are analyzed; and issuing traffic warnings from the control center based on the analysis of the determined directions of travel of the vehicles and a geographic location at the control center to ensure the vehicles cooperate in an efficient and safe manner.

2. The method as claimed in claim 1, wherein the directions of travel of the vehicles are determined by the vectors of all vehicles being grouped in accordance with an angle which the respective vector forms with a reference vector.

3. The method as claimed in claim 2, wherein the vehicles are each assigned a specific range of angles of a specific direction of travel when the directions of travel are determined.

4. The method as claimed in claim 3, wherein one of (i) the roadways and (ii) the lanes of the roadways of the traffic infrastructure are determined by the vectors of all vehicles being grouped in accordance with a normal distance of the receiver from the respective vector.

5. The method as claimed in claim 3, wherein one of (i) the roadways and (ii) the lanes of the roadways of the traffic infrastructure are determined by the vectors of all vehicles being grouped in accordance with a normal distance of the receiver from the respective vector.

6. The method as claimed in claim 4, wherein an averaged entry point and an averaged exit point of those vehicles driving along one of (i) the roadway and (ii) the lane is determined for each roadway or lane of the roadways.

7. The method as claimed in claim 1, wherein the status data is detected by the vehicles.

8. The method as claimed in claim 1, wherein the status data is communicated periodically to the receiver.

9. The method as claimed in claim 1, wherein the position received as a last position of the vehicle is the position for which, after being communicated to the receiver, no further status data of the vehicle has reached the receiver for a defined period.

10. The method as claimed in claim 1, wherein accuracy of the method is increased via additional topology information.

11. The method as claimed in claim 1, wherein one of (i) the receiver and (ii) the processor divides a maximum detection region into a plurality of segments.

12. The method as claimed in claim 1, wherein the first position comprises a position of the vehicle received as the first position in the detection region and the second position comprises the position of the vehicle received as a last position in the detection region.

13. A receiver for fixed arrangement in traffic infrastructure; comprising:

a processor including a first memory; and a second memory;

wherein the receiver when arranged in the traffic infrastructure is configured to receive status data from vehicles, said status data each including at least a position of a respective vehicle and if necessary a time at which a position was determined and communicated by wireless communication to the receiver when arranged in the traffic infrastructure a number of times by the vehicles while the vehicles passed through a detection region of the receiver;

wherein one of (i) the receiver when arranged in the traffic infrastructure and (ii) a processor connected to the receiver when arranged in the traffic infrastructure is further configured to calculate a vector for each vehicle, the vector extending from a first position to a second position;

wherein one of (i) the receiver when arranged in the traffic infrastructure and (ii) the processor is further configured to determine directions of travel of the vehicles and a geographic position of at least one of the roadways and the lanes of the roadways of the traffic infrastructure in the detection region from vectors of all the vehicles; and wherein the receiver when arranged in the traffic infrastructure is further configured to forward the determined directions of travel of the vehicles and a geographic location to a control center in which the determined directions of travel of the vehicles and a geographic location are analyzed, the control center issuing traffic warnings based on the analysis of the determined directions of travel of the vehicles and a geographic location at the control center to ensure the vehicles cooperate in an efficient and safe manner.

14. The receiver as claimed in claim 13, wherein the first position comprises a position of the vehicle received as the first position in the detection region and the second position comprises the position of the vehicle received as a last position in the detection region.

15. A non-transitory computer program product comprising a computer program and directly loadable into one of (i) a first memory of a receiver disposed in traffic infrastructure and (ii) a second memory of a processor assigned to the receiver which, when executed by one of (i) the receiver and (ii) the processor, causes geographic region detection of the traffic infrastructure via the receiver disposed in the traffic infrastructure for a detection region of the receiver, the computer program code comprising:

program code for communicating several times to the receiver disposed in the traffic infrastructure, by vehicles, status data of the vehicles during a period in which the vehicles pass through the detection region of the receiver via wireless communication, the status data each including at least a position of a respective vehicle and if necessary a time at which the position was determined;

program code for computing, by one of (i) the receiver disposed in the traffic infrastructure and (ii) a processor connected to the receiver, a vector for each vehicle, the vector extending from a first position to a second position;

program code for determining, by one of (i) the receiver disposed in the traffic infrastructure and (ii) the processor from vectors of all vehicles, directions of travel of the vehicles and a geographic location of at least one of (i) roadways and (ii) lanes of the roadways of the traffic infrastructure in the detection region; and program code for transmitting the determined directions of travel of the vehicles and a geographic location to a control center in which the determined directions of travel of the vehicles and a geographic location are analyzed, the control center issuing traffic warnings based on the analysis of the determined directions of travel of the vehicles and the geographic location to ensure the vehicles cooperate in an efficient and safe manner.

* * * * *